United States Patent [19]

Eisner

[11] Patent Number: 4,491,041

[45] Date of Patent: Jan. 1, 1985

[54] TOOL FOR REMOVING MANDREL MOUNTED DISKS

[76] Inventor: Jeffrey W. Eisner, 634 W. Hazel, Roseburg, Oreg. 97470

[21] Appl. No.: 481,992

[22] Filed: Apr. 4, 1983

[51] Int. Cl.[3] ..... B25B 17/00

[52] U.S. Cl. ..... 81/55

[58] Field of Search ..... 29/281.1; 81/55, 56, 81/13; 269/71

[56] References Cited

U.S. PATENT DOCUMENTS

| | | | |
|---|---|---|---|
| 705,932 | 7/1902 | Kennedy | 81/13 |
| 1,390,071 | 9/1921 | Wetzstein | 81/55 |
| 4,209,166 | 6/1980 | De Roven | 269/71 |
| 4,313,725 | 2/1982 | Lieb et al. | 81/55 |
| 4,358,971 | 11/1982 | Favonio | 81/55 |

*Primary Examiner*—Robert C. Watson

*Attorney, Agent, or Firm*—James D. Givnan, Jr.

[57] ABSTRACT

A base supported tool having a holder with one jaw of the holder slidably carrying a screwdriver. The remaining jaw is recessed to receive the mandrel of a powered handpiece. A plate on the jaw is also recessed and has flats to engage flats on the mandrel to hold the latter against rotation during removal of a mandrel screw. A pin supports the plate for limited rocking motion to facilitate mandrel entry into the recess. The holder may pivot also for the purpose of mandrel entry into the plate recess.

4 Claims, 5 Drawing Figures

TOOL FOR REMOVING MANDREL MOUNTED DISKS

BACKGROUND OF THE INVENTION

The present invention pertains generally to tools or jigs within which a hand held tool may be temporarily positioned for the purpose of modifying the last mentioned tool as, for example, removing an abrading disk from a mandrel chucked within a dental handpiece.

Frequent replacement of small abrading disks are necessary in dental laboratory work and over a day's time constitute considerable time consuming effort. Contributing to the problem is the fact that the abrading disks are held in place by a small mounting screw with mandrel rotation tends to tighten. By necessity the screw is quite small and requires considerable breakaway torque when removing. Heretofore, it has been necessary for the user to manually hold the handpiece in a manner preventing mandrel rotation while attempting to back out the mounting screw with a screwdriver. In work where many abrading disks are used each day, such as dental laboratory work, considerable effort is expended in removing and substituting new disks.

The known prior art discloses a number of tools having both nut retaining and fastener driving capabilities such as, for example, U.S. Pat. Nos. 1,390,071, 1,270,766, 1,260,698 and 1,677,473. The tools disclosed in said patents perform in the combined manner of a screwdriver and wrench with the wrench feature serving to loosen or tighten a lock nut on the threaded fastener.

SUMMARY OF THE PRESENT INVENTION

The present invention is embodied within a tool for placement on a work table to receive a modified handpiece mandrel and confine same against rotation while removing a fastener from the mandrel end.

The present tool includes a bifurcated holder having a plate thereon configured to receive flats on a mandrel. Said plate is adapted for limited rocking motion to facilitate reception of the mandrel flats. Further, bevelled surfaces on the plate serve to guide the mandrel flats downwardly into abutment with planer surfaces on the plate. Located adjacent the above mentioned plate is a recess formed in the holder within which a conical portion of the mandrel is received.

Important objectives of the present tool include the provision of a tool having a holder of bifurcated configuration having a yieldably mounted plate thereon with which the flats on a mandrel may be engaged to secure the mandrel against rotation during removal of a mandrel screw; the provision of a tool having a swingably carried holder which may move about an upright axis to facilitate reception of the mandrel shank; the provision of a tool having a holder equipped with a mandrel receiving plate which may move in a rocking manner about a horizontal axis to receive the mandrel regardless of misalignment of the mandrel flats and flat abutting surfaces on said plate.

DETAILED DESCRIPTION OF THE PREFERRED EMBODIMENT

Figure 1:
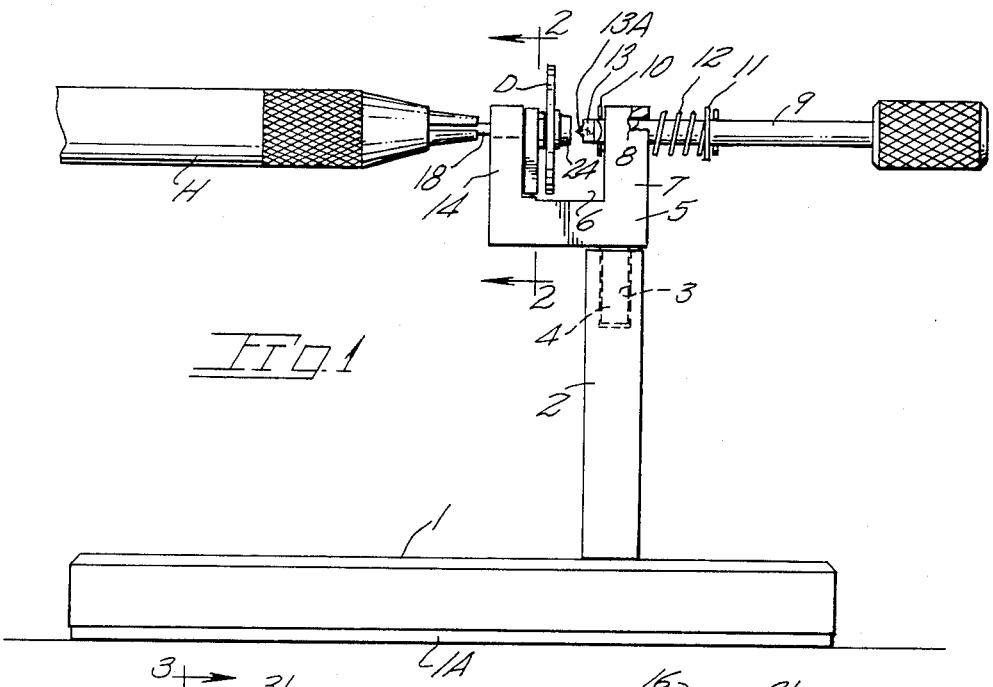
FIG. 1 is a front elevational view of the present tool.

With continuing attention to the drawing wherein reference numerals indicate parts hereinafter similarly identified, the reference numeral 1 indicates a base on a non-slip pad 1A.

A post 2 on the base has an upwardly opening bore 3 in which is received a pivot pin 4 integral with a holder 5. Pin 4 is off-center from the holder vertical axis to support the holder in cantilever fashion to permit same to swing freely about the upright pin axis to facilitate alignment of the holder with the mandrel of a hand held handpiece H.

Holder 5 is bifurcated to define a bit area 6. A holder jaw at 7 is bored at 8 to slidably receive the shaft 9 of a screwdriver confined at 10 and 11 for limited axial movement. A spring 12 biases the screwdriver blade 13 to a retracted position. Blade 13 includes a central projection 13A for seating within a fastener recess as later described.

A remaining jaw at 14 defines a recess 15 in a top wall 16 within which is received the shank 18A of a mandrel 18 of the type used in powered handpiece H. Jaw recess 15 terminates in a radiused surface at 20 which receives a conical mandrel portion at 19. A mandrel head at 21 may be of hexagonal shape having a series of flats 22 thereon. A face 23 abuts an abrading disk D when in place on the mandrel. A machine screw at 24 defines a central conical recess 26 within which seats projection 13A of the driver to assure driver-fastener alignment. Mandrel shank 18 is enlarged at 18A to permit the formation of a threaded bore to receive screwshank 25.

Figure 2:
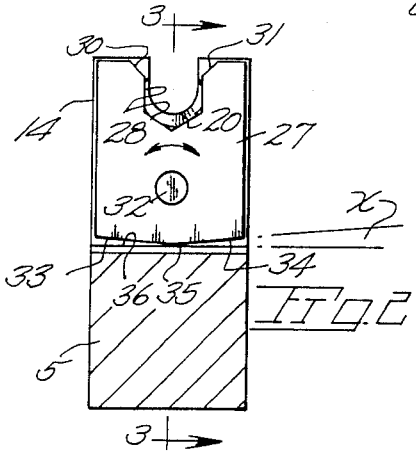
FIG. 2 is a vertical sectional view taken along line 2—2 of FIG. 1.
Figure 3:
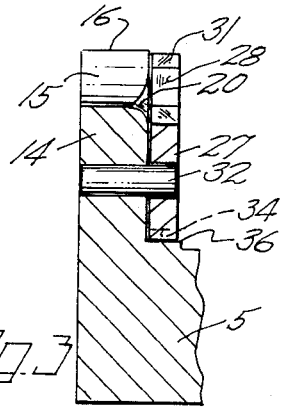
FIG. 3 is a vertical sectional view taken along line 3—3 of FIG. 2.
Figure 4:
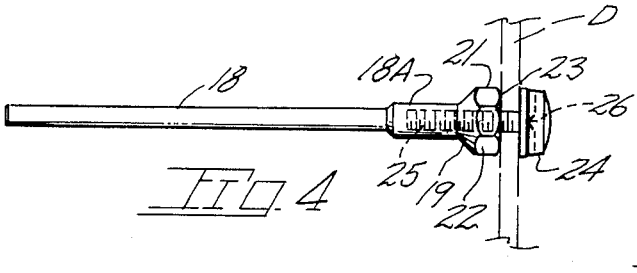
FIG. 4 is a side elevational view on an enlarged scale of a mandrel modified for use with the present tool.
Figure 5:
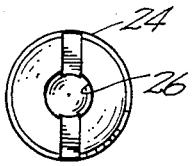
FIG. 5 is an end elevational view on an enlarged scale taken from the righthand side of FIG. 4.

With attention to FIGS. 2 and 3 wherein a retainer plate 27 is best disclosed, planer surfaces 28 define an upwardly open area within which is received mandrel head 21 with the surface 28 being abutted by the flats 22 on the mandrel head. Chamfers at 30 and 31 facilitate the downward entry of said head flats into flat abutment.

A pin at 32 yieldably couples retainer plate 27 with holder jaw 14. Retainer plate bottom edges at 33 and 34 are inclined upwardly and outwardly from an edge midpoint 35 to permit rocked displacement of the plate per the arrows in FIG. 2 during reception of the mandrel head. Accordingly, tedious alignment of the small mandrel head flats 22 with the plate flats 28 is not necessary during mandrel insertion. A slight rocking motion of the handpiece H in conjunction with chamfers 30 and 31 and the yieldably mounted retainer plate make for virtually immediate seating of the small mandrel head regardless of misalignment of the head and the plate flats 28. The typical included angle X defined by retainer plate edge 33 or 34 and a horizontal plane, common to a jaw shoulder 36, may be approximately five degrees.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A tool for temporarily holding a handpiece mounted mandrel against rotation during mandrel disassembly, said tool comprising, a base, a holder supported by said base and defining a bite area adapted for reception of a mandrel end, a plate on said holder having planar surfaces defining an upwardly opening recess with said surfaces adapted for abutment with flats formed on the mandrel to hold the latter against rotation, pin means coupling said plate to said holder in a manner permitting limited rocking motion of said plate to facilitate mandrel reception, and a screwdriver slidably mounted in said holder and adapted for axial engagement with a screw on the mandrel end to remove a mounting screw thereon preparatory to removing a disk from said mandrel.

2. The tool claimed in claim 1 wherein said holder limits rocking movement of said plate.

3. The tool claimed in claim 1 wherein said base additionally includes a post, said holder swingably carried by said post for holder travel in a horizontal plane to facilitate holder alignment with a handpiece mandrel.

4. The tool claimed in claim 3 wherein said holder is supported in cantilever fashion by said post.

* * * * *